US007681475B2

(12) United States Patent
Fabbro

(10) Patent No.: US 7,681,475 B2
(45) Date of Patent: Mar. 23, 2010

(54) AUTOMATIC BOTTLE OPENER WITH WORM STOPPER

(76) Inventor: Alberto Fabbro, Viale Udine 36, 33010 Cassacco (UD) (IT)

( * ) Notice: Subject to any disclaimer, the term of this patent is extended or adjusted under 35 U.S.C. 154(b) by 0 days.

(21) Appl. No.: 12/029,200

(22) Filed: Feb. 11, 2008

(65) Prior Publication Data

US 2008/0210057 A1 Sep. 4, 2008

Related U.S. Application Data

(63) Continuation of application No. PCT/EP2006/007807, filed on Aug. 7, 2006.

(30) Foreign Application Priority Data

Aug. 10, 2005 (IT) ..... UD2005A0132

(51) Int. Cl.
*B67B 7/00* (2006.01)
*B67B 7/04* (2006.01)

(52) U.S. Cl. ..... 81/3.29; 81/3.2; 81/3.33

(58) Field of Classification Search ..... 81/3.29, 81/3.2, 3.09, 3.48, 3.36, 3.37, 3.45, 3.31, 81/3.33, 3.55
See application file for complete search history.

(56) References Cited

U.S. PATENT DOCUMENTS

| | | | | |
|---|---|---|---|---|
| 562,645 | A * | 6/1896 | McMaster | 81/3.33 |
| 676,205 | A * | 6/1901 | Rogginger | 81/3.31 |
| 4,253,351 | A | 3/1981 | Allen | |
| 5,335,142 | A | 8/1994 | Anderson | |
| 6,308,592 | B1 * | 10/2001 | Turnwald | 81/3.29 |
| 6,321,620 | B1 * | 11/2001 | Fabbro | 81/3.2 |

FOREIGN PATENT DOCUMENTS

| | | |
|---|---|---|
| FR | 2 318 103 | 2/1977 |
| WO | 01/70620 | 9/2001 |

OTHER PUBLICATIONS

International Search Report, Oct. 18, 2006, 3 pages.
Written Opinion, Oct. 18, 2006, 5 pages.

* cited by examiner

*Primary Examiner*—Hadi Shakeri
(74) *Attorney, Agent, or Firm*—St. Onge Steward Johnston & Reens LLC

(57) ABSTRACT

An automatic bottle opener using a mechanical system that automatically stops rotation of the worm screw only in anti-clockwise direction during the extraction stage. A rotation stopper having a one-way bearing for coupling the stopper to the worm screw allows the screw to rotate when displaced axially in one direction, but prevents such rotation when axially displaced in the opposite direction.

7 Claims, 4 Drawing Sheets

AUTOMATIC BOTTLE OPENER WITH WORM STOPPER

CROSS-REFERENCE TO RELATED APPLICATIONS

The present application is a continuation of pending International patent application PCT/EP2006/007807 filed on Aug. 7, 2006 which designates the United States and claims priority from Italian patent application UD2005A000132 filed on Aug. 10, 2005, the content of which is incorporated herein by reference.

FIELD OF THE INVENTION

This invention is applied to particular bottle openers, called automatic bottle openers, of the type already known and it consists of an innovation, an improvement on the said openers that in general are able to open wine bottles.

In particular the invention is useful when the bottles, rather than being closed with the normal cork closures, are closed with another type of closure called synthetic closures.

These closures are made from plastic material, silicone etc. and are usually more viscid and more slippery than cork.

In the type of bottle openers that are to be considered and where the invention has an application, the worm-screw (screw), during the extraction stage of the closure from the bottle neck in an anti-clockwise rotation motion, does not dispose of any stop other than that represented by the friction that the closure offers on the bottle neck.

If this friction is not sufficient, the worm-screw, once it has penetrated the closure in the bottle neck and then been pushed upwards in order to carry out the extraction, can be unthreaded with an anti-clockwise rotary movement and the opening does not take place.

The aim of the invention is to obviate this disadvantage.

BACKGROUND OF THE INVENTION

Automatic bottle openers are know that are applied to a wall or to a table or are also directly placed on the neck of the bottle and are held there tight during the opening operation. Allen. U.S. Pat. No. 4,253,351.

In this type of bottle opener, the worm-screw does not penetrate the closure due to the pushing effect and the rotary movement produced by the operator's hand but rather because it is pushed to penetrate with only a downward axial movement and the rotation is imposed as it is constrained, during this movement, to cross a nut or nut screw, that forces it to rotate.

With this type of bottle opener, it is possible to distinguish two families; in the first, as that described by Allen U.S. Pat. No. 4,253,351, it is the worm-screw itself that crosses the nut to assume the rotary movement; in the second family, the one that we shall be considering, the worm-screw has the sole function of penetrating the closure in order to extract it and the rotary movement is assumed by means of a complementary helicoidal screw integral with the worm, positioned on the same axis.

In the bottle openers where the worm crosses the nut (Allen), to complete the opening operation and release the worm from the closure, two complete movements are necessary from the top downwards and vice-versa.

Instead, in the type of bottle openers that are to be considered and described and where the invention will find an application, the worm makes a single movement, first downwards to penetrate the closure, then upwards, with a single operation to extract said closure and proceeding in the same movement to release it after from the closure.

This second method allows a faster operation that is safer, less complex, with less breakages and improved simplicity of construction, however it presents the disadvantage, as already mentioned and until now unresolved, that if in the extraction stage the closure does not offer sufficient friction on the worm, the worm is unthreaded from the closure that remains perforated in the bottle.

Said friction is necessary with respect to the worm, in the prolongation of its upward axis, it is fixed to a movable support by means of an idle system, a bearing, two flanges etc. that do not offer any type of stop to the rotation of the worm.

The need for the worm-screw to be free to rotate in both directions derives from the fact that first, when it is pushed into the closure it must rotate clockwise to penetrate it and then once the closure has been extracted from the neck of the bottle it must still be free to rotate in the opposite direction, namely anti-clockwise, to be able to release itself from the closure itself.

As long as it concerns cork closures, the extraction operation is generally successful. However, in the last few years, new types of closures have appeared on the market, namely synthetic closures: (Silicone plastic material etc.). These closures offer the advantage of being odourless and not having unpleasant flavours, they generally cost less and their use is increasingly widespread.

In general, these closures are viscid, slippery and impose less friction on the worm-screw than that normally imposed by cork, therefore during the opening operations, the worm penetrates the closure but when the movement is inversed and pushed upwards in order to achieve extraction, the worm, not disposing of any other way of stopping in rotation can be unthreaded with the anti-clockwise rotary movement and the closure remains perforated but in the neck of the bottle and therefore opening does not take place.

SUMMARY OF THE INVENTION

The aim of this invention is to avoid this disadvantage and for this reason, during the single extraction stage, a mechanical system is made to take over automatically that substitutes the lack of friction and keeps the worm blocked in rotation so as to as allow the extraction and then in the process of the same upward movement, still to leave it free in the anti-clockwise rotation, so that the worm can release itself from the closure. This also allows all types of closures to be extracted and without almost greater cost or greater effort.

DETAILED DESCRIPTION OF THE INVENTION

This description that is intended as illustrative and not limitative will be provided with a series of drawings that give an improved understanding of the invention.

In the field of bottle openers that we will be considering, the assembly that has the worm-screw to carry out the opening and release of the closure only executes one movement from the top downwards and only one subsequent inverse movement.

In this process, we can distinguish four different work stages.

Starting from the rest position, the sequences will have the following order.

First stage=Approach of the worm to the closure

Second stage=Penetration in the closure

Third stage=Extraction of the closure from the neck of the bottle

Fourth stage=It is the stage in which the worm is released from the closure.

Figure 1:
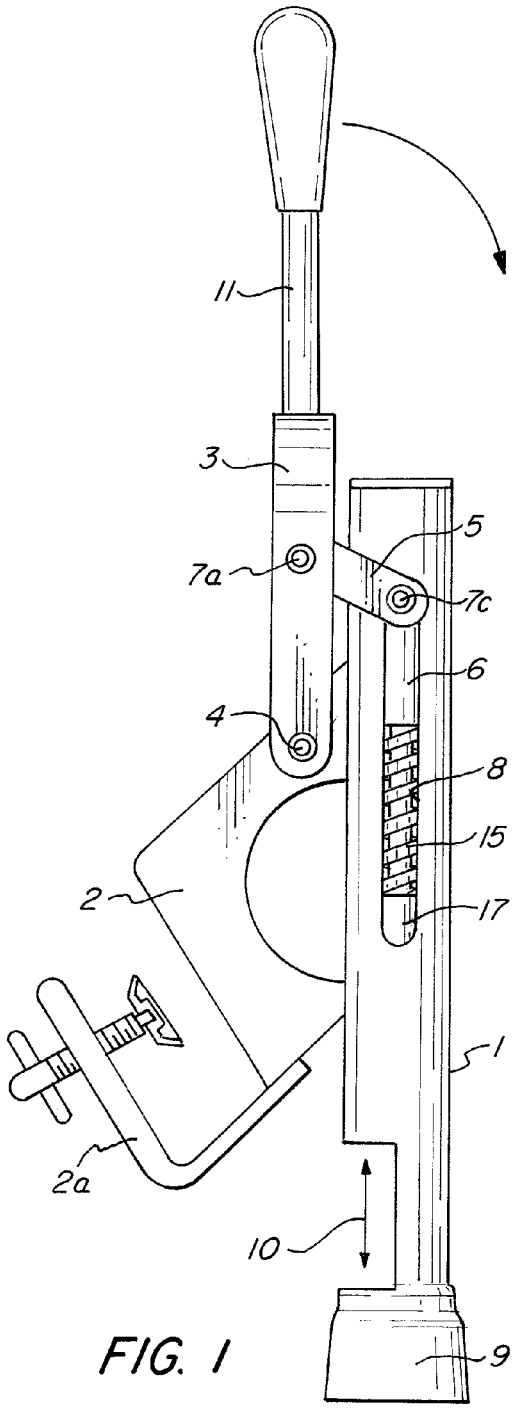
FIG. 1 is a side view of a bottle opener in accordance with the invention.

FIG. 1 shows a general view of one of these bottle openers, called automatic, in which the worm 16 assumes the rotary movement since a helicoidal screw 15 integral to it and placed on the same axis is forced to cross a nut screw 17 that in the downward and upward movements will force said worm to rotate.

As set out in FIG. 1, the bottle opener is in the resting position and is seen from the side.

The number 1 indicates the external tubular casing, with 2 a support base on a table to which will it be locked by means of a clamp 2*a*.

The numbers 11 and 3 indicate a lever that in the lower part 3 extends in a U-shape to encompass the casing.

Said lever is connected to the support base 2 by means of a pin 4.

From the two prolongations of the U-shaped lever 3 originate two arms 5 connected to said lever by two pins 7*a*-7*b* and on the opposite side, said arms connect to a small cylindrical block 6 placed in the casing 1 by means of two pins 7*c*-7*d*.

At the base, the casing 1 comprises a receptacle 9 where the neck of the bottle 28 will be placed in abutment and immediately above, comprising an empty sector 10, face downwards to allow the closure to exit once extracted from the neck of the bottle.

The casing 1 also comprises, laterally on both sides, two openings 8 that will allow the two pins 7*c*-7*d* and therefore the small cylindrical block 6 to make the downward and upward movement during the work stages.

Figure 2:
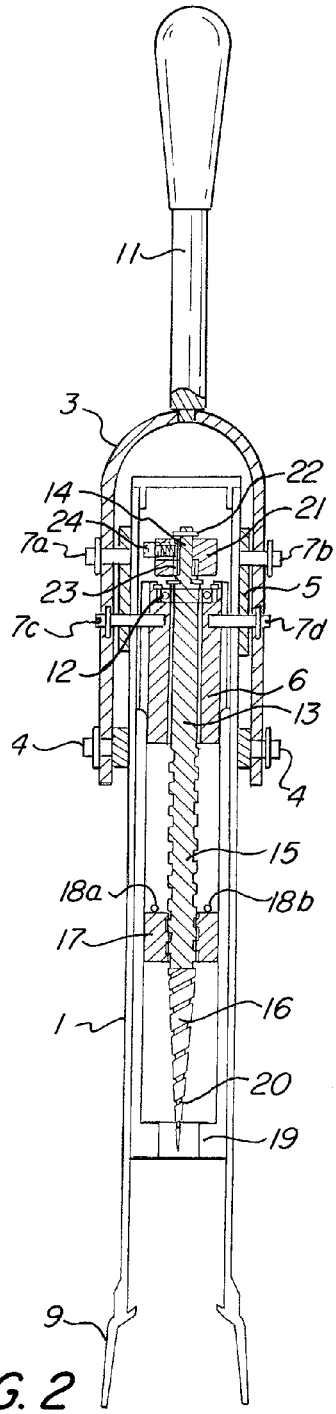
FIG. 2 is a partially cross-sectional, front elevational view of the bottle opener of FIG. 1.

FIG. 2 is a section seen from the front of the same bottle opener in FIG. 1 made to rotate clockwise at 45[deg.]. In this Figure it is to be noted how the two arms 5 that originate from the lever 3 are connected with the small cylindrical block 6 by means of the two pins 7*c*-7*d*. These two pins are locked on the said small block 6 with a screw system.

The small cylindrical block 6 is longitudinally perforated in the centre along its entire its length and on the upper part said perforation extends to make a seat with a bearing 12 that is locked here and that will have a thrust bearing function.

Said small block 6, is free in the casing to scroll from above to below and vice-versa, but cannot rotate.

A pin 13 passes in said central perforation of the small block 6, said pin is free to rotate in the small block and in the upper part it is fixed to the central ring of the bearing 12. Said pin 13 continues upwards with an appendix 14 with a smaller diameter.

On the pin 13, proceeding downwards and under the small block 6, a helicoidal screw 15 is obtained for a section of 7-9 cm. and at the base of said screw the worm-screw 16 is connected integrally.

The screw of said worm 16 will have the same pitch as the helicoidal screw 15.

The helicoidal screw 15 crosses a small cylindrical block 17, said small block has a nut screw function. Said nut screw 17 can scroll axially in the casing but cannot rotate and is blocked in the upward movement by a series of stops 18*a*-18*b* secured on the casing itself 1.

Still on the casing 1, towards the bottom and at the height where the point of the worm reaches 16 in the resting position, a flange 19 is secured, perforated in the centre in order to allow the passage of the worm 16 and the helicoidal screw 15.

From said flange 19, a series of relieves or ribs 20 that will be better seen in another drawing, extend upwards in contact and fixed on the inside wall of the casing 1.

After having described a large part of the details, attention is now drawn to the pin 14. It is on this pin that the novelty regarding the invention is found. On said pin 14, a small cylindrical block 21 is inserted held over by a stop 22.

Said small block 21 is perforated in the centre and can rotate on the pin 14.

The small block 21 includes in the lower part a free wheel 23 with HF type rollers.

Said free wheel is fixed on the small block 21 and is suitable for working on the pin 14; this is directed so that the pin 14, the pin 13, the helicoidal screw 15 and therefore eventually also the worm-screw 16 can freely rotate in the clockwise direction even if the small block 21 and free wheel 23 included, do not rotate.

However, in the anti-clockwise rotary motion, the pin 14 and eventually also the worm 16, cannot rotate if the free wheel 23 and the small block 21 do not also rotate with them.

Said small block 21, includes on its exterior, a series of projections 24.

The particulars will be seen in more detail in the following Figures.

Figure 3:
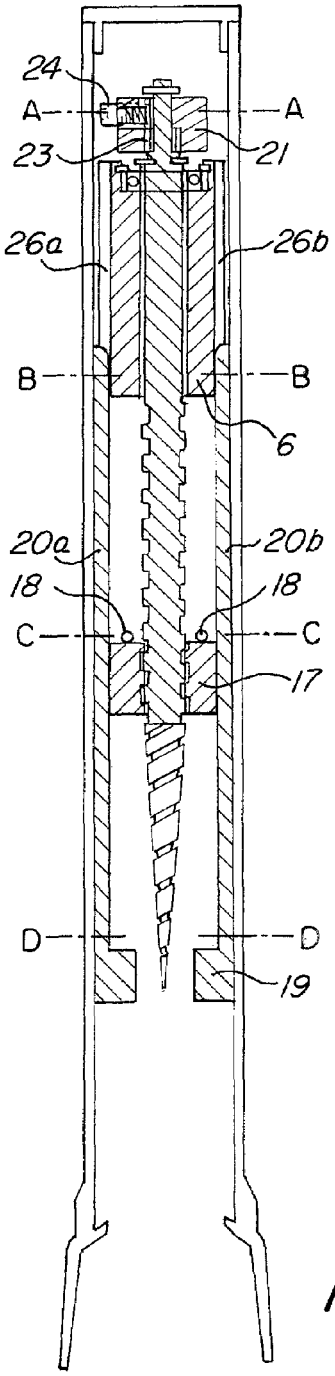
FIG. 3 is a partially cross-sectional, side view of the bottle opener of FIG. 2 without the lever.

FIG. 3 is something of a repetition of FIG. 2 but as seen from the side and namely made to rotate with respect to this in the anti-clockwise direction at 45[deg.].

Due to a question of space, the drawing of levers 11-3-5 is not repeated as the movement and the working of the invention can equally be understood.

Moreover, it is not that these levers are always necessary as the downward and upward movement essential to obtaining opening can also be obtained by the force of a small electric motor that, for example, in the movement downward can make the screw-worm rotate in order to make it penetrate the closure.

FIG. 3 highlights the two relieves or ribs 20*a*-20*b* that originate from the flange 19 and extend over a well defined section upward and in the case described here, until penetrating a few millimetres into the base of the small block 6 in two lateral grooves 26 on said small block made over its entire length.

Figure 4:
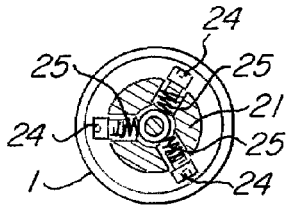
FIG. 4 is a cross-sectional top view of the bottle opener of FIG. 3 along line IV-IV.

FIG. 4 shows in plan view the section IV-IV of the small block 21. This small block, on its upper part, above the free wheel 23, presents three equidistant grooves, hollowed as a trench, and in each one of these grooves a spring 25 is positioned which, on one side towards the centre of the small block 21, is fixed on this and on the other part towards the exterior a small pin 24 is positioned that projects to the exterior.

The small pin 24 can be a screw that for a small section is screwed on the spring. 25.

Figure 5:
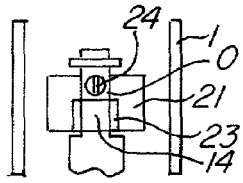
FIG. 5 is an exposed side view of the top of the bottle opener of FIG. 3.

FIG. 5, is a front elevation of the small block 21, made to rotate 45[deg.] anticlockwise with respect to FIG. 3. The trench groove 0 on the upper part is highlighted. These grooves will act as a counter shoulder to the small pins 24 when they strike the ribs 20.

Figure 6:
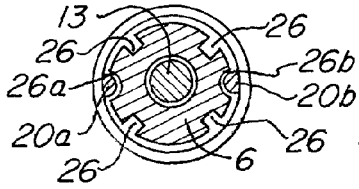
FIG. 6 is a cross-sectional top view of the bottle opener of FIG. 3 along line VI-VI.

FIG. 6, is a plan view of the section B-B. This section is practically the lower part of the small cylindrical block 6.

It is noted how this small block 6 past the central hole, comprises for the entirety of its length, various lateral grooves. Of these, two 26*a*-26*b* will serve to allow the passage of the two ribs 20*a*-20*b* the other four 26 will serve to allow the small block 6, in the movement downwards, to go past the stops 18 placed in a fixed way further below on the casing 1.

Figure 7:
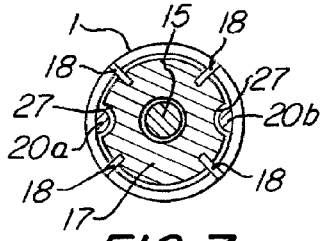
FIG. 7 is a cross-sectional top view of the bottle opener of FIG. 3 along line VII-VII.

FIG. 7, is a plan view of the section C-C that corresponds to the upper part of the nut screw 17.

The four stops 18 are highlighted that originating in a secured way from the casing 1, project for a few millimetre from the interior of the casing in order to block the upward movement of the nut screw 17, moreover the two grooves 27 are highlighted that are obtained laterally on the same nut screw so that the latter can scroll longitudinally along the two ribs 20*a*-20*b* but not rotate.

Figure 8:
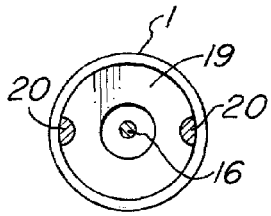
FIG. 8 is a cross-sectional top view of the bottle opener of FIG. 3 along line VIII-VIII.

FIG. 8, shows in plan view the section D-D that corresponds to the upper part of the flange 19.

The flange 19 is highlighted from where the two ribs 20 extend upwards.

The flange 19 is perforated in the centre and the point of the worm 16 is highlighted.

This flange 19, is secured in a fixed way to the casing 1 as are also the relieves or ribs 20.

After having described the various components that form the bottle opener, the four stages and the movements for understanding working will now be described.

Figure 9:
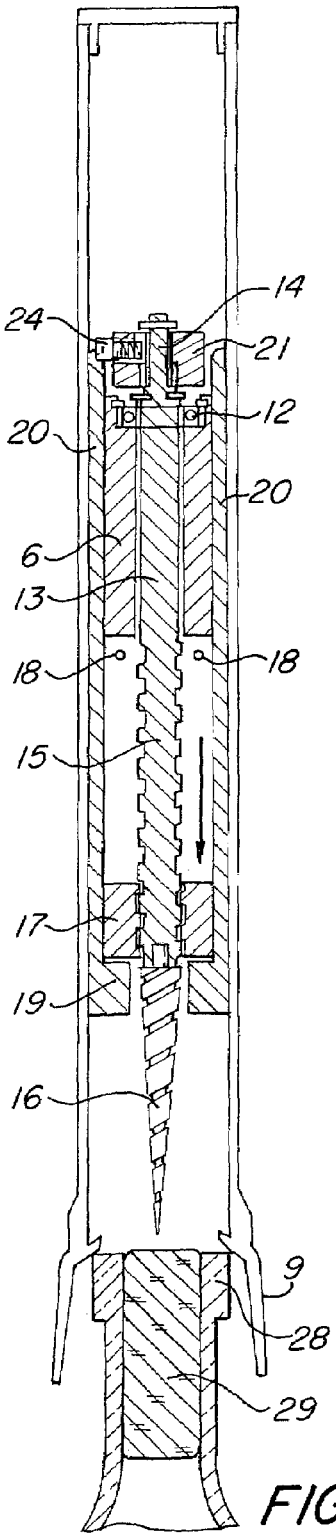
FIG. 9 is a partially cross-sectional, side view of the bottle opener of FIG. 3 when in the first working stage.

In the first working stage, FIG. 9, from the rest position seen in the previous FIG. 1, by lowering the lever 11 the movement of the arms 5 is also obtained and therefore also the movement downwards of the small cylindrical block 6 and therefore also of the whole assembly that is connected to this small block 6 by means of the bearing 12.

Therefore the movement downwards of the entire apparatus will take place and the point of the worm 16 will approach the top of the neck of the bottle 28 and the closure 29, placed under the base 9 of the bottle opener.

Also the nut screw 17, not encountering obstacles, will move downwards together with the helicoidal screw 15 until striking the upper part of the flange 19.

This first stage, defined as transfer, is idle and there is no rotation.

Together with the entire assembly, the small block 21 will also be lowered, placed higher up on the pin 14 and the small pins 24, when the nut screw 17 is in abutment on the flange 19, will be positioned near the highest point of the ribs 20.

Figure 10:
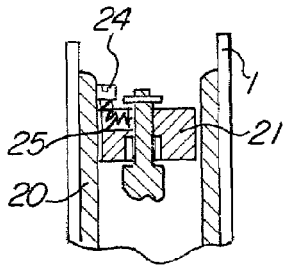
FIG. 10 is an exposed side view of the top of the bottle opener of FIG. 5 when one of the pins strikes the head of one of the ribs.

FIG. 10 shows what could occur if one of the small pins 24 in the process of the movement downwards, should strike the head of one of the ribs 20.

In this case, the spring 25 to which the small pin is connected, will allow said pin to take a position so as not to obstruct the assembly in the process of the movement downwards, which could occur if the small pin 24 were fixed on the small block 21.

The case represented with FIG. 10, is extreme and normally does not occur because even if the small pin 24 struck the head, at the top of the rib 20, said pin, aided by the flexibility of the spring and by the fact that the small block 21 can rotate, will position itself immediately at one side or the other of the ribs 20.

It is to be noted that the small pin 24 can assume that position only in the movement from above downwards while in the opposite movement, namely upwards, it will remain blocked between the trench groove 0 and it will behave as if it were fixed on the small block 21.

The reason for which the projections 24 of the small block 21 are connected with it by means of a flexible system 25 can now be understood.

Here, the first stage is completed.

Figure 11:
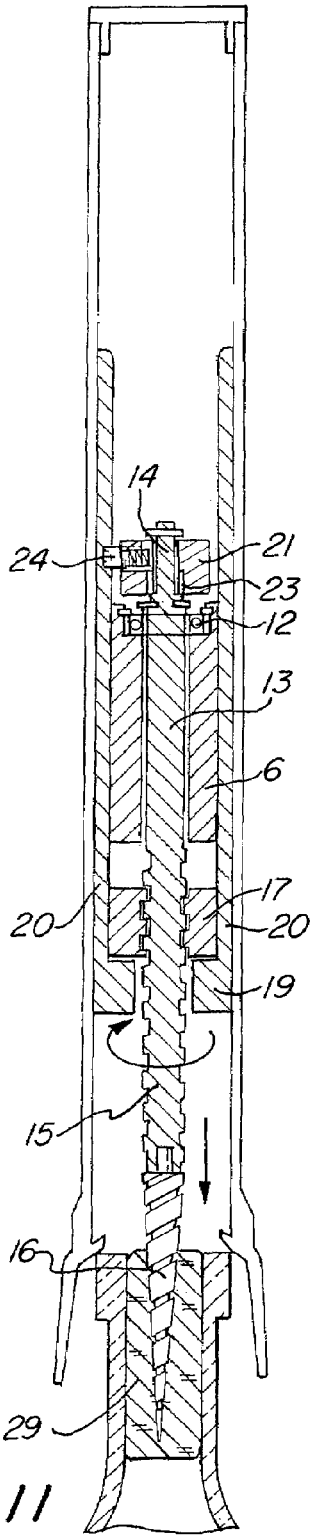
FIG. 11 is a partially cross-sectional, side view of the bottle opener of FIG. 3 when the small block has achieved the lower dead center.

Proceeding in the downward movement, the second stage will begin FIG. 11 that consists in the penetration of the worm 16 in the closure 29.

In this second stage, since the nut screw 17 has struck the upper part of the flange 19 and is blocked here in the movement downwards and is still blocked in the rotary motion by the ribs 20, the helicoidal screw 15 in order to be able to proceed in the movement will be forced to rotate clockwise and thus the worm 16 that is pushed downwards and rotating will penetrate the closure 29.

This rotation is possible because the entire movable assembly that starts from the pin 13, is fixed on the central ring of the bearing 12 that has a thrust bearing function and allows therefore the entire assembly connected with it to rotate freely both in the anti-clockwise and clockwise direction.

FIG. 11 shows the position that the various components come to assume when the small block 6 in the downward movement has achieved the lower dead centre.

Now we will examine what occurred and how the small block 21 behaved.

When the helicoidal screw 15, pushed downwards started to rotate, the pin 13 and the pin 14 also followed that movement.

The small block 21, positioned on pin 14 where the free wheel 23 operates, by means of inertia, will begin a rotary movement together with the pin 14 and this will continue until one of the small pins 24 strikes one of the ribs 20.

At this point, the small block 21, will be obstructed in the rotary motion and will proceed downwards without rotating. This fact will not prevent, however, the rotation of the pin 14 since, in that clockwise rotation direction, thanks to the free wheel, it is free to rotate even if the small block 21 and said free wheel 23 do not rotate.

Figure 12:
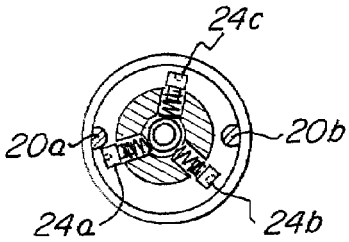
FIG. 12 is a cross-sectional top view of the bottle opener of FIG. 3 along line IV-IV during the penetration stage of the worm in the closure.

Proceeding in the movement, it is understood therefore that the small pin 24*a* in contact with the rib 20*a* FIG. 12 will follow the movement of the assembly downwards, sliding and touching the wall of the rib 20*a* until it reaches the lower dead centre.

FIG. 12 shows in plan view, the position that the small pins 24*a*-24*b*-24*c* will have taken with respect to the ribs 20*a*-20*b* during the penetration stage of the worm in the closure.

The small pin 24*a* will be in contact with the rib 20*a* while the other two small pins 24*b*, 24*c* will be free in the space between the casing 1, the small block 21 and at a certain distance from the rib 20*b*.

Here the second stage is completed, the one that we call penetration.

Figure 13:
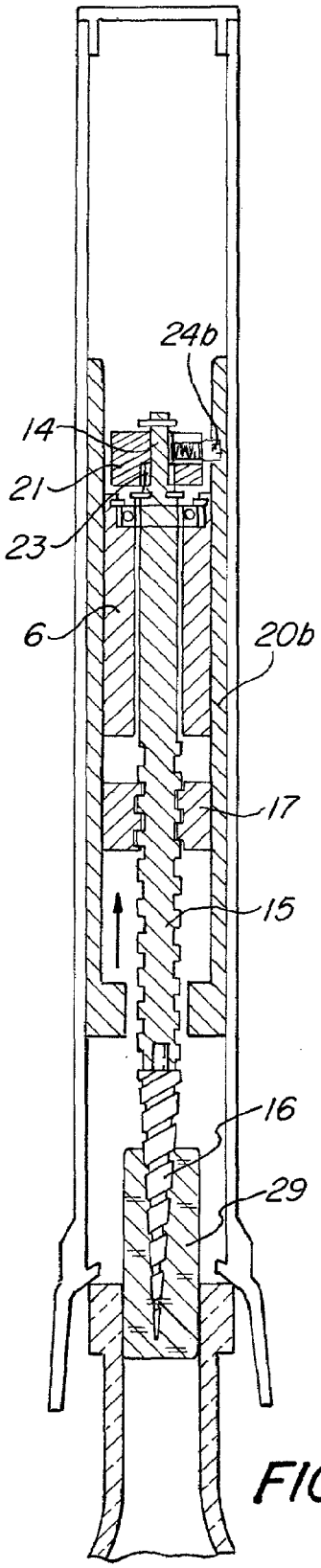
FIG. 13 is a partially cross-sectional, side view of the bottle opener of FIG. 3 during the extraction of the closure from the neck of the bottle.

The following third stage FIG. 13 will be that in which the extraction of the closure from the neck of the bottle takes place and it is in this stage that the invention finds its application.

In order for the operation to be carried out, it is necessary to invert the force on the small block 6 to push the assembly upwards. We repeat that in this stage, it is essential that the worm only has upward axial movement and is not rotated.

Pushing upwards, the entire system will move away from the top of the neck of the bottle and if the closure 29 offers sufficient grip and friction on the worm 16 the opening will take place.

In this case, the friction offered by the closure being sufficient to keep the worm blocked, there is no anti-clockwise rotation of said closure and eventually, also the pin 14 and the small block 21 that includes the free wheel 23, will move upwards with only the axial movement and with the small block 21 the small pin 24 will also follow the movement, maintaining the position, with respect to the ribs 20, assumed during the previous penetration stage.

In this case therefore the invention that is presented here does not intervene and the opening will be carried out according to the traditional system.

Instead the behaviour of the worm will be different and as a result of the axis that supports it, until reaching the pin 14 where the small block 21 is positioned with the respective free wheel, if the closure does not offer sufficient grip and friction on the worm.

In this case, as the closure 29 is tightly held in the neck 28 and offers a certain resistance to extraction and considering the fact that it does not offer sufficient friction, the worm, free in rotary motion when the upwards movement begins, rather than operate the extraction will prefer to attempt to unthread itself from this closure by starting an anti-clockwise rotary movement.

This fact will also cause the rotation of the pin 14 and also the small block 21 that now, due to the effect of the free wheel 23 is integral with said small block. This start of rotation will last until one of the small pins 24 strikes against one of the ribs 20.

Figure 14:
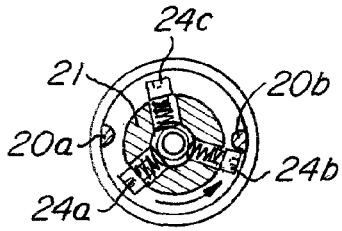
FIG. 14 is a cross-sectional top view of the bottle opener of FIG. 3 along line IV-IV when the upper movement of the closure does not offer sufficient friction on the worm.

FIG. 14 shows in plan view, the position that the small pins 24 are to assume when in the movement upwards the closure does not offer sufficient friction on the worm. In this case, the small pin 24*a* will be moved away from the rib 20*a* until the small pin 24*b* strikes against the rib 20*b*.

The way in which the small pins 24 are arranged with respect to the ribs 20 will determine the width of the rotation angle that the small block 21 can carry out before one of the small pins 24 goes against one of the ribs 20 and in conclusion before the invention takes effect.

This rotation angle, with the closure blocked between the neck of the bottle and the worm in this, must be as small as possible in order not to lose the opening effect.

In an attempt to reduce the space between the small pins and the ribs, these have been arranged according to the drawing in FIGS. 12 and 14.

At this point, proceeding in the upward movement, the small pin 24*b*, will follow that axial movement, sliding while supported and rubbing along the wall of the rib 20*b* thus preventing the rotation to the small block 21 and therefore also to the axis that starts from the pin 14 to the worm 16 and namely until the extraction of the closure is not possible.

The lower the friction offered by the closure 29 on the worm 16, the greater will be the rubbing force of the pin 24*b* on the rib 20*b*.

In this case, the small pin 24*b* is practically placed to replace and compensate the low friction offered by the closure.

In this third stage, the nut screw 17, already when the upward movement begins, not encountering any obstacles, and being included in the helicoidal screw 15 that does not rotate, must follow the upward movement until it goes against the stops 18.

The fact that the pin 24 does not allow the rotation of the pin 14, together with the fact that the nut screw 17 moves upwards following the axial movement of the helicoidal screw 15, will be the motive for which the entire axis, including the worm that is now found within the closure, moves upwards without rotating.

When the nut screw 17 is in abutment on the stops 18, the worm 16 will have passed upwards, making a sufficient space to extract the closure and the opening will take place.

The fourth stage will begin in which the worm is released from the closure.

Figure 15:
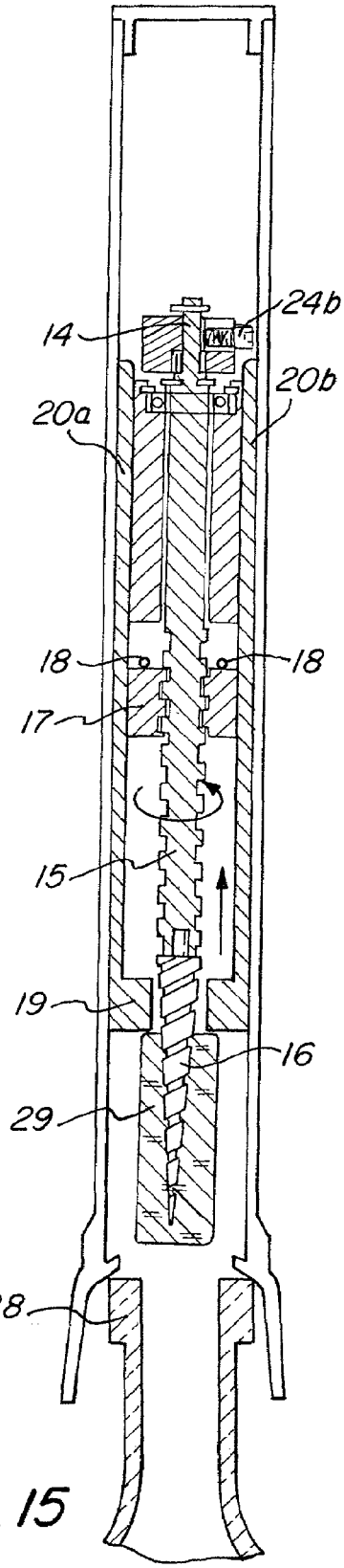
FIG. 15 is a partially cross-sectional, side view of the bottle opener of FIG. 3 when the nut screw has stricken the stops.

FIG. 15, shows the position that the various components have come to assume when the nut screw 17, in its upward movement, has struck the stops 18.

The closure 29 extracted from the neck of the bottle 28 is seen placed towards the lower part of the flange 19 and with the worm 16 inside.

The most important aspect now is that it is fundamentally important in the end to obtain the result that the invention intended to achieve as well as that of observing the position the small pins 24 have taken in this moment. They have now overcome the highest part of ribs 20 and are in a position in which, in the process of the upward movement, not encountering obstacles in the casing, are free to rotate together with the small block 21, the pin 14 and eventually therefore also with the worm 16.

At this point, continuing in movement, the nut screw 17 being blocked both in the rotary motion (the ribs 20), as well as in axial movement (the stops 18), the helicoidal screw 15, in order to be able to proceed upwards, is forced into anti-clockwise rotation and in that direction will make the entire axis rotate including the worm 16.

The closure 29, included in the worm 16 will be in abutment at the base of the flange 19 and here will remain blocked without the possibility of rotating, as a result, the upward movement and the contemporary anti-clockwise rotation of the worm 16, will make the worm release itself from the closure 29 for the lower part of the flange 19 to disappear further.

The closure released in this way can exit the bottle opener across the perforation 10 of the casing 1.

The upward movement can occur until the top dead centre has been reached that coincides with the rest stage (FIG. 1).

At this point the opening has taken place, the closure has been expelled by the bottle opener and the assembly is ready to start a new operation.

The importance and the function of the ribs 20 that together with the free wheel 21 with the small pins 24, allow the realization of the invention is now understandable.

It is important to establish the point that the ribs 20 can reach in their upward extension. This point will must always be below that reached by the small pins 24 at the moment in which the nut screw 17 is in abutment against the stops 18 because this is the moment in which the rotary motion begins.

What is claimed is:

1. A bottle opener for extracting a bottle closure disposed in the neck of a bottle, comprising:

a casing with a support base for receiving the neck of a bottle, said casing having an inner flange with an aperture therethrough, wherein said casing includes an inner wall having a plurality of ribs extending longitudinally therealong;

a screw disposed in said casing, said screw having a first end with a penetration tip for penetrating a closure disposed in the neck of the bottle, a second end, and a threaded portion;

an actuator coupled to said screw that axially displaces said screw relative to said casing;

a screw nut disposed in said casing, in which the threaded portion of said screw is disposed such that, when said actuator axially displaces said screw toward the support base of said casing, said screw nut is axially displaced with said screw until said screw nut abuts said flange and said screw rotates and moves axially relative to said screw nut while said screw nut abuts said flange; and a block disposed in said casing, said block having a channel in which the second end of said screw is disposed, a free wheel by which the second end of said screw is coupled to said block, and a plurality of projections extending radially therefrom such that rotation of said block is restrained in at least one direction when one of said projections abuts one of said ribs, such that, when said actuator axially displaces said screw toward the support base of said casing, the second end of said screw rotates relative to said block, and when said actuator axially displaces said screw away from the support base of said casing, said block restrains the rotation of said screw.

2. The bottle opener of claim 1, wherein said plurality of ribs is two ribs and said plurality of projections is three projections.

3. The bottle opener of claim 1, wherein said projections are connected to said block by flexible members.

4. The bottle opener of claim 3, wherein:

said block includes a plurality of radial channels therein;

said flexible members comprise springs disposed in said radial channels; and said projections are coupled to said springs.

5. The bottle opener of claim 4, wherein said projections comprise screws screwed to said springs.

6. The bottle opener of claim 1, wherein the actuator comprises a handle.

7. The bottle opener of claim 1, wherein the actuator comprises an electric motor.

* * * * *